US010688347B2

(12) United States Patent
McCredie

(10) Patent No.: US 10,688,347 B2
(45) Date of Patent: Jun. 23, 2020

(54) SWIMMING FLIPPER

(71) Applicant: DMC Industries PTY LTD, Avalon Beach (AU)

(72) Inventor: Donald Bruce McCredie, Avalon Beach (AU)

(73) Assignee: DMC Industries PTY LTD, Avalon Beach (AU)

( * ) Notice: Subject to any disclaimer, the term of this patent is extended or adjusted under 35 U.S.C. 154(b) by 0 days.

(21) Appl. No.: 16/098,139

(22) PCT Filed: May 2, 2017

(86) PCT No.: PCT/AU2017/050404
§ 371 (c)(1),
(2) Date: Nov. 1, 2018

(87) PCT Pub. No.: WO2017/190189
PCT Pub. Date: Nov. 9, 2017

(65) Prior Publication Data

US 2019/0151718 A1 May 23, 2019

(30) Foreign Application Priority Data

May 6, 2016 (AU) ..... 2016901687

(51) Int. Cl.
*A63B 31/11* (2006.01)
*A63B 31/00* (2006.01)

(52) U.S. Cl.
CPC ..... *A63B 31/11* (2013.01); *A63B 31/00* (2013.01); *A63B 2031/112* (2013.01); *A63B 2208/03* (2013.01); *A63B 2209/00* (2013.01)

(58) Field of Classification Search
CPC ..... A63B 31/00; A63B 31/08; A63B 31/11; A63B 31/12; A63B 31/16; A63B 31/14
USPC ..... 441/64, 61, 62; D21/806
See application file for complete search history.

(56) References Cited

U.S. PATENT DOCUMENTS

| | | | | |
|---|---|---|---|---|
| 3,422,470 | A | 1/1969 | Mares | |
| 3,649,979 | A | 3/1972 | Macniel | |
| 4,778,423 | A * | 10/1988 | Ciccotelli | A63B 31/11 441/64 |
| 4,838,824 | A | 6/1989 | Mccredie | |
| 5,290,194 | A | 3/1994 | Sneddon et al. | |
| 5,358,439 | A | 10/1994 | Paolo | |
| 6,227,924 | B1 * | 5/2001 | Miller | A63B 31/11 441/64 |

(Continued)

*Primary Examiner* — Lars A Olson
(74) *Attorney, Agent, or Firm* — Hertzberg, Turk & Associates, LLC

(57) ABSTRACT

A swimming flipper (1) comprising a foot portion (2) and substantially flat blade portion (3) extending there from, said blade portion (3) having provided on each longitudinal side thereof at least two opposed rails (4/5) extending inwardly and at an angle equal to or less than 90 degrees to the plane of said blade portion (3), and said blade portion (3) having provided at least two ridges (7/8) preferably underneath the blade portion (3) extending longitudinally from the foot portion (2), said foot portion (2) having provided a one-piece strap (6), and said foot portion (2) having provided at least two fixed couplings (11/12) to engage and disengage with the corresponding and opposing couplings of another said flipper portion (1) to interlock and hold two flippers attached to each other.

10 Claims, 3 Drawing Sheets

(56) References Cited

U.S. PATENT DOCUMENTS

| | | | | |
|---|---|---|---|---|
| 6,843,693 | B2 * | 1/2005 | McCarthy | A63B 31/11 441/64 |
| 6,955,575 | B1 * | 10/2005 | Hsieh | A63B 31/11 441/64 |
| 2005/0118904 | A1 | 6/2005 | Belloni | |

* cited by examiner

SWIMMING FLIPPER

CROSS REFERENCE TO RELATED APPLICATION

This Application is the U.S. National Stage filing under 35 U.S.C. § 371 of PCT Application Ser. No. PCT/AU2017/050404 filed on May 2, 2017, which claims priority to Australian Patent Application No. 2017202641 filed on Apr. 20, 2017, which in turn claims priority to Australian Provisional Patent Application 2016907687 filed on May 6, 2016. The PCT Application and the Australian Patent Applications are herein incorporated by reference in their entirety.

TECHNICAL FIELD

The present invention relates to improvements in the design and performance of flippers used for swimming that provide the wearer improved propulsion when swimming or carrying out water based activities.

BACKGROUND

The present invention relates to improvements in swimming flipper design and performance for wearers to gain improved propulsion when swimming or performing other water based activities with the flippers. Flippers are commonly used to provide additional propulsion for the wearer and are widely used in swimming, scuba diving, body surfing, body boarding, surf rescue and swimming training.

An important factor in successful body surfing or body boarding in the ocean when riding the hollow or curved surface of a wave is the ability to maintain traction on this part of the wave wall and enable the body surfer or body boarder to maintain their position in this important buoyancy or "sweet spot" section of the wave. This important section of the wave buoys, balances and propels the body surfer or body boarder forward without the wave "breaking" on top of them or allowing them to be thrown out through the curl of the wave. The thrust, propulsion and directional movement provided by flippers as extensions of the wearer's feet enables the body surfer or body boarder to accurately control and manage their position in relation to the wave wall and therefore stay within this important section of the wave so as to "ride" the wave.

Traditional flippers are usually substantially flat rubber flaps which extend from a shoe portion to amplify the kicking effect of the wearer by increasing the area of water displaced by each kick of their feet. However, this kicking affect is reduced by the escape of the displaced water moving unobstructed over each edge of the flipper surface during the upward and downward movement thereof. Also, the control of directional movement required in body surfing and body boarding applications is limited by only two control "edges" being provided on either side of each flipper. Further, flippers without rails when moving through water have varying amounts of water flow around them that becomes disrupted as it flows over the flipper's surfaces due to the varying terrain of the flipper's surface, which typically results in eddies being formed that push water back towards to flipper causing varying amounts of water drag around the flipper.

It is an object of the present invention to increase the functional effectiveness of traditional flippers by reducing water displacement losses, reducing water drag, improving directional movement control by providing an increased number of control surfaces such as "edges", "ridges" and "rails" to each flipper, increasing water traction, increasing thrust and hence wearer's speed during upward and downward movement of each flipper.

SUMMARY OF INVENTION

According to one aspect, the invention provides a swimming flipper comprising a foot portion and a substantially flat blade portion extending there from, said blade portion having provided on each longitudinal edge thereof at least two opposed rails extending inwardly and at an angle above and below relative to the flat blade of said flipper, and having provided two ridges extending underneath the blade from the foot portion to provide wearer stability when walking out of water and stiffness for kicking in water, and said foot portion having and at least two fixed couplings that can be engaged and disengaged into the corresponding and opposing couplings of opposing foot portion couplings to interlock and hold flippers attached to each other when not being worn by user. For preference, said rails extend substantially the length of each longitudinal edge of said flipper portion.

Preferably, at least two substantially upright ridge members are provided underneath the surface of the flipper portion. Said ridge members preferably extend underneath the blade longitudinally from the foot portion equidistant either side of the centreline towards the front blade edge of said flipper portion.

For preference, said flipper is either heat injection or compression moulded from rubber or plastic like material, so as to provide a durable, resilient and flexible flipper. In a further preferred form the shoe portion and the rail above the flat blade portion of the swimming flipper are made more flexible and elastic than the flipper portion so as to provide comfort to the wearer without loss of propulsion efficiency and controlled release of displaced water moving over and around each side of the flipper.

BRIEF DESCRIPTION OF DRAWINGS

A preferred embodiment of the invention will now be described, by way of example only, with reference to the accompanying drawings in which.

DESCRIPTION OF EMBODIMENTS

Figure 1:
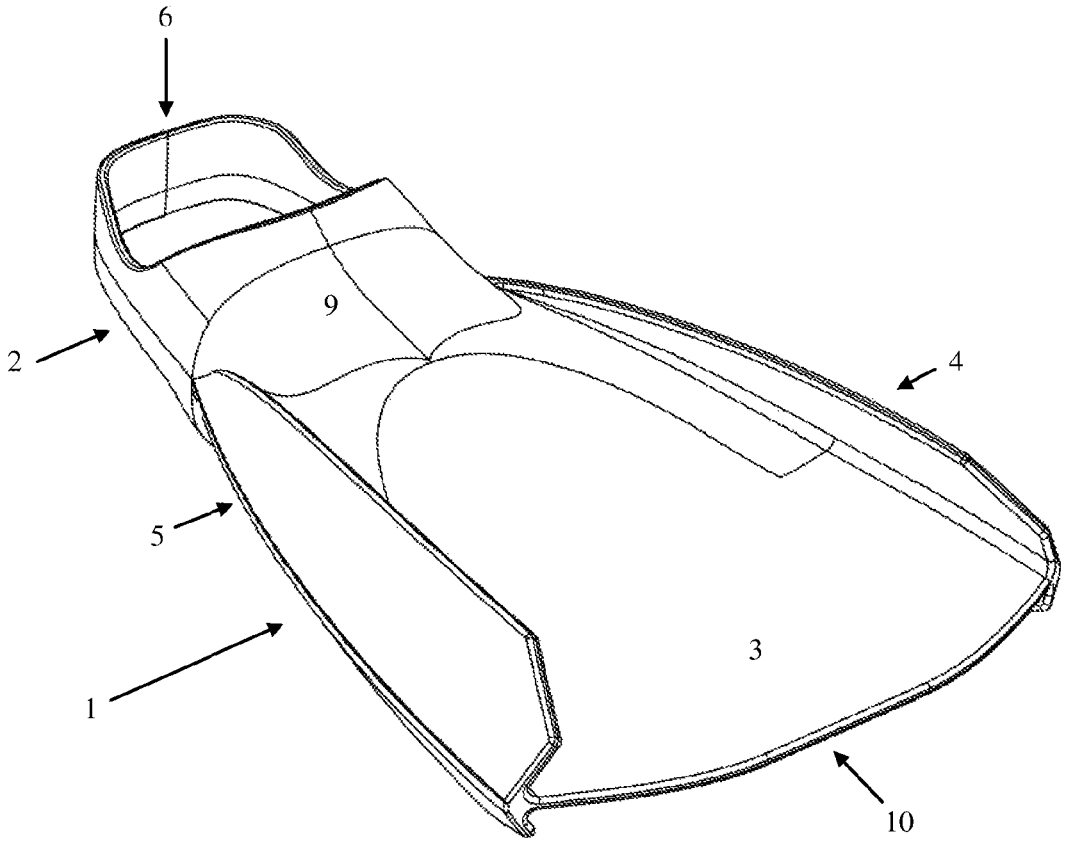
FIG. 1 shows a plan perspective view of the swimming flipper according to the invention.
Figure 3:
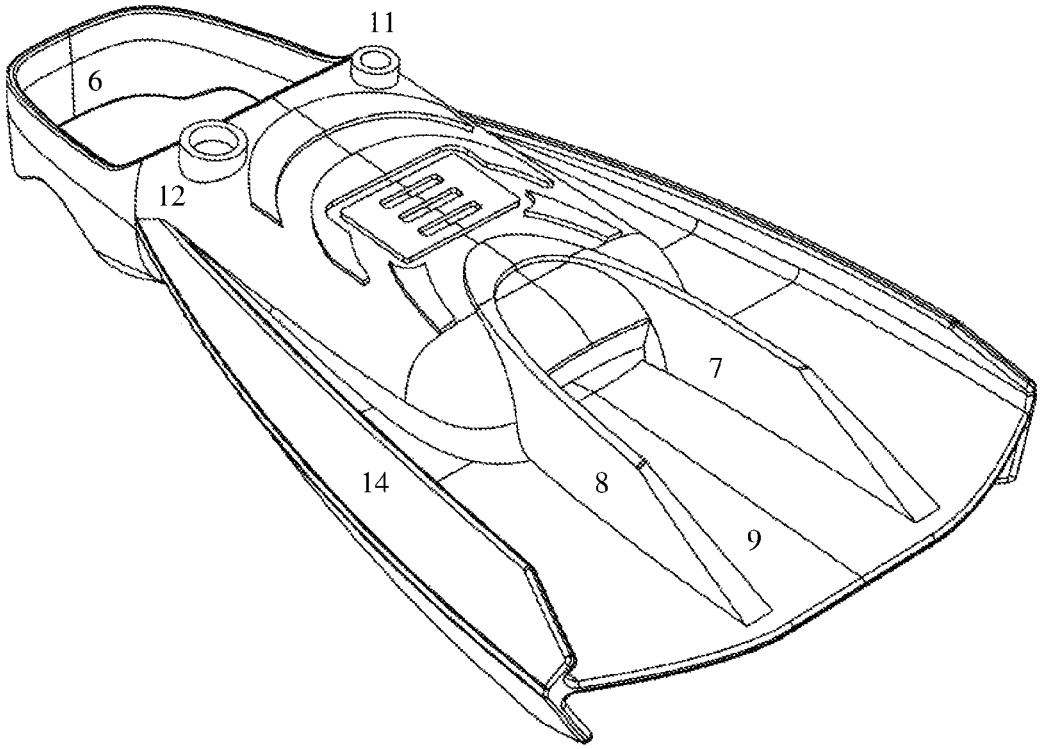
FIG. 3 shows an underside perspective view of the flipper of FIG. 1.

Referring to the drawings, the swimming flipper 1 comprises a foot portion 2 and substantially flat blade portion 3. Each longitudinal side of the blade portion 3 has a pair of rails 4 and 5 provided thereon. These rails 4 and 5 as shown in FIGS. 1 and 3 extend inwardly at an angle equal to or less than 90 degrees above and below the flat blade portion 3 forming the shape of a sideways 'V' when viewed inwardly from the front blade edge 10. The foot portion 2 has provided a moulded and flexible one-piece strap 6 formed to provide an entrance hole that enables the foot of the wearer to be inserted into the cavity of the foot portion 2. The said blade portion 3 is provided two substantially upright ridges 7 and 8 preferably underneath the blade 3 extending longitudinally from the foot portion 2 equidistant from the centreline 9 towards the front blade edge 10 of said flipper portion. The said foot portion 2 is provided at least two couplings 11 and 12 equidistant and either side of the centreline 9 fixed perpendicularly from the underside of the foot portion 2 that engaged and disengaged into the corresponding and opposing couplings of another said flipper 1 portion to interlock and hold flippers attached to each other when not being worn by user. For preference, said rails 4 and 5 extend substantially the length of each longitudinal edge of said flipper 1 portion.

Figure 2:
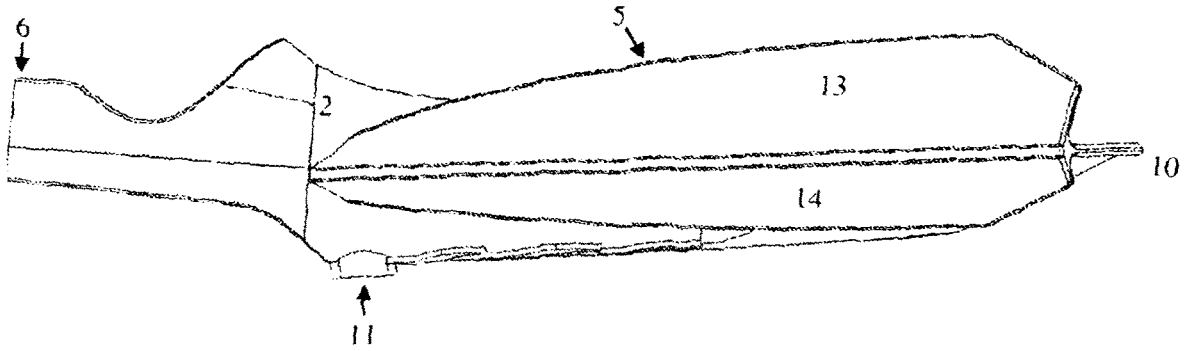
FIG. 2 shows a side elevation view of the flipper shown in FIG. 1.

The side rails 4 and 5 are mirror opposites of each other in profile and preferably are tapered towards the front and rear of the flipper 1 while broadening out towards the centre of the flipper portion edges as shown in FIG. 2. The surface area 13 of rails 4 and 5 positioned above the blade portion 3 is equal to or greater than the surface area 14 of rails 4 and 5 positioned below the blade portion 3. Further, the rails 4 and 5 are moulded so as to smoothly merge into the foot portion 2 of the flipper 1 so as to minimise their coefficient of friction.

In use, the side rails 4 and 5 capture, temporarily hold and channel the water being displaced towards the front blade edge 10 of the flipper 1 during both upward and downward movement of the flipper. This channeling of water reduces the loss of displaced water over each side of the blade portion 3 surface by capturing and holding a volume of water for a period of time approximating to the time between each upward and downward movement within the rails 4 and 5, which increases the amount of water being thrust towards the front blade edge 10, which in turn increase the forward propulsive force provided during kicking of the flipper by the wearer. The side rails 4 and 5 further provided increased traction and directional control by increasing the number of surfaces or edges engaging with the water and therefore provide the wearer with the ability to use the flipper 1 to create a "rudder like" effect when being propelled forward by a wave.

The underside of the blade portion 3 is further provided with at least two substantially upright ridges 7 and 8 extending longitudinally and parallel to rails 4 and 5 from the foot portion 2 equidistant either side of the centreline 9 towards the front blade edge 10 of said flipper 1 portion to provide wearer stability when walking and additional directional control when in water.

In a further preferred form the shoe portion 2 and the rail area 13 positioned above the flat blade portion 3 of the swimming flipper 1 are made more flexible and elastic than the other areas of the flipper portion 1 to enable this area of the rail 13 to flex responsively to the pressure of flowing water, provide comfort to the wearer without loss of propulsion efficiency and to provide controlled release of displaced water moving over and around edges of the flipper 1.

It will be apparent to those skilled in the art that the invention is not limited to the specific embodiments described and further embodiments and exemplifications of the invention are possible without departing from the spirit or scope of the invention described.

The invention claimed is:

1. A swimming flipper comprising:

a foot portion, and a substantially flat blade portion extending from said foot portion, said blade portion having provided on each longitudinal side thereof at least two opposed rails, each of said at least two opposed rails extending inwardly towards the plane of said blade portion and at an angle less than 90 degrees to the plane of said blade portion, wherein said rails are mirror opposites of each other in profile and extend substantially the length of each longitudinal edge of said blade portion forming the shape of a sideways V when viewed inwardly from front blade edge of the flipper, said blade portion having provided at least two ridges extending longitudinally from the foot portion, said foot portion having provided a one-piece strap, and said foot portion having provided at least two fixed couplings to engage and disengage with the corresponding and opposing couplings of another swimming flipper to interlock and hold two flippers attached to each other.

2. The swimming flipper according to claim 1, wherein said rails are tapered towards the front and rear of the flipper while broadening out towards the center of the blade portion edges.

3. The swimming flipper according to claim 1, wherein said rails are molded to smoothly merge into the side of the foot portion to minimize their coefficient of friction and potential drag when used.

4. The swimming flipper according to claim 1, wherein said rails above the blade portion are provided a surface area equal to or greater than the surface area of rails below the blade portion.

5. The swimming flipper according to claim 4, wherein said rails above the blade portion are made more flexible and elastic than the other areas of the swimming flipper to enable this area of the rails to flex responsively to the pressure of flowing water, provide comfort to the wearer without loss of propulsion efficiency and provide controlled release of displaced water moving over and around edges of the flipper.

6. The swimming flipper according to claim 1, wherein said blade portion has provided two substantially upright ridges underneath the blade portion extending longitudinally and parallel to said rails from the foot portion equidistant either side of the flipper centerline towards the front blade edge.

7. The swimming flipper according to claim 1, wherein said foot portion has provided said at least two fixed couplings positioned and orientated perpendicularly from the underside of the foot portion and equidistant from either side of the flipper centerline.

8. The swimming flipper according to claim 1, wherein said foot portion has provided a molded and flexible one-piece strap to provide an entrance hole which enables the foot of the wearer to be easily inserted into the cavity of the foot portion.

9. The swimming flipper according to claim 7, wherein said fixed couplings have an internal size inside the receiving coupling that is equal to or smaller than the external size of the opposing coupling to optimize the friction required to hold two flippers attached to each other.

10. A swimming flipper comprising:

a foot portion, and a substantially flat blade portion extending from said foot portion, said blade portion having provided on each longitudinal side thereof at least two opposed rails, each of said two opposed rails extending inwardly towards the plane of said blade portion and at an angle less than 90 degrees to the plane of said blade portion, wherein said rails are mirror opposites of each other in profile and extend substantially the length of each longitudinal edge of said blade portion forming the shape of a sideways V when viewed inwardly from front blade edge of the flipper, and said blade portion having provided at least two ridges extending longitudinally from the foot portion.

* * * * *